US011183085B2

(12) United States Patent
McGuire et al.

(10) Patent No.: US 11,183,085 B2
(45) Date of Patent: Nov. 23, 2021

(54) ANTI-COUNTERFEITING DEVICE AND METHOD

(71) Applicant: LAVOISIER LLC, Philadelphia, PA (US)

(72) Inventors: Matthew McGuire, Philadelphia, PA (US); Anastasia D'Orazio, Philadelphia, PA (US); Meet Pravin Vora, Philadelphia, PA (US)

(73) Assignee: SAFESTAMP INC.

( * ) Notice: Subject to any disclaimer, the term of this patent is extended or adjusted under 35 U.S.C. 154(b) by 587 days.

(21) Appl. No.: 15/775,878

(22) PCT Filed: Nov. 14, 2016

(86) PCT No.: PCT/US2016/061907

§ 371 (c)(1),
(2) Date: May 14, 2018

(87) PCT Pub. No.: WO2017/083860

PCT Pub. Date: May 18, 2017

(65) Prior Publication Data

US 2018/0322813 A1 Nov. 8, 2018

Related U.S. Application Data

(60) Provisional application No. 62/254,503, filed on Nov. 12, 2015.

(51) Int. Cl.
*G09F 3/00* (2006.01)
*B42D 25/378* (2014.01)
(Continued)

(52) U.S. Cl.
CPC ..... *G09F 3/0294* (2013.01); *B42D 25/30* (2014.10); *B42D 25/36* (2014.10); *B42D 25/364* (2014.10); *B42D 25/378* (2014.10)

(58) Field of Classification Search
CPC ..... D21H 21/48; B42D 25/364; B42D 25/24; B42D 25/29; B42D 2033/04;
(Continued)

(56) References Cited

U.S. PATENT DOCUMENTS 4,516,679 A 5/1985 Simpson et al.
6,835,430 B2 * 12/2004 Morii ..... G03H 1/0248 283/81
(Continued)

FOREIGN PATENT DOCUMENTS

CN 102296486 A 12/2011
CN 102428365 A 4/2012
(Continued)

OTHER PUBLICATIONS

Chinese Office Action and Search Report from Corresponding CN Application No. 2016800658259 dated May 21, 2019.
(Continued)

*Primary Examiner* — Nimeshkumar D Patel
*Assistant Examiner* — Tania Courson
(74) *Attorney, Agent, or Firm* — Belles Katz LLC

(57) ABSTRACT

The present invention is directed to an anti-counterfeiting device comprising a first sensor configured to undergo a first user perceptible change in response to a first biologically produced stimulus that emanates directly from a biological source; and a second sensor configured to undergo a second user perceptible change in response to a second biologically produced stimulus that emanates directly from the biological source. The second biologically produced stimulus is different than the first biologically produced stimulus.

20 Claims, 9 Drawing Sheets

(51) Int. Cl.
*B42D 25/364* (2014.01)
*B42D 25/36* (2014.01)
*B42D 25/30* (2014.01)

(58) Field of Classification Search
CPC ..... B42D 2033/08; B42D 2033/14; B42D 2033/26; B42D 2035/24; B42D 25/36; B42D 25/30; B42D 25/378; G09F 2003/0283; G09F 3/0294
See application file for complete search history.

(56) References Cited

U.S. PATENT DOCUMENTS 8,168,355 B2 * 5/2012 Purdy ..... G02B 5/1857 430/9
8,336,481 B2 * 12/2012 Klots ..... B41M 3/14 116/200
8,641,933 B2 * 2/2014 Purdy ..... B82Y 20/00 252/586
8,823,663 B2 * 9/2014 Ryu ..... G06F 3/041 345/173
9,075,020 B2 * 7/2015 Lawandy ..... G01N 21/643
9,189,604 B2 * 11/2015 Lawandy ..... G07D 7/1205
9,304,074 B2 * 4/2016 Asher ..... G01N 1/38
9,475,334 B2 * 10/2016 Lawandy ..... G01N 21/783
9,694,518 B2 * 7/2017 Kotov ..... B42D 25/00
9,834,029 B2 * 12/2017 MacPherson ..... G02B 26/004
2002/0152928 A1 * 10/2002 Lawandy ..... B41M 5/28 106/31.13
2005/0116464 A1 * 6/2005 Isherwood ..... B42D 25/00 283/72
2007/0110965 A1 5/2007 Bergsmann
2008/0122218 A1 * 5/2008 Reid ..... G07D 7/12 283/83
2009/0038512 A1 * 2/2009 Xu ..... G02B 5/0252 106/287.35
2009/0045618 A1 * 2/2009 Williams ..... B42D 25/29 283/85
2009/0322070 A1 * 12/2009 Reichelsheimer ..... B41M 3/142 283/5
2010/0045027 A1 2/2010 Whiteman
2010/0208313 A1 8/2010 Horgan et al.
2010/0245044 A1 * 9/2010 Dietemann ..... B42D 25/364 340/5.86
2010/0254581 A1 10/2010 Neeser et al.
2010/0288182 A1 11/2010 Klots et al.
2013/0147179 A1 6/2013 Baloukas et al.
2013/0258445 A1 10/2013 Arsenault

FOREIGN PATENT DOCUMENTS

CN 104136229 A 11/2014
CN 104464505 A 3/2015
CN 104797682 A 7/2015
KR 20140063435 A 5/2014
WO 2006009810 A1 1/2006
WO 2013/040704 3/2013

OTHER PUBLICATIONS

Chinese Office Action and Search Report from Corresponding CN Application No. 2016800658259 dated Jan. 16, 2020.
European Search Report from related European Application No. 16865240.2 dated Jul. 22, 2019.
Search Report issued in Corresponding Chinese Patent Application No. 2016800658259 dated Jun. 30, 2020.

* cited by examiner

ANTI-COUNTERFEITING DEVICE AND METHOD

CROSS-REFERENCE TO RELATED APPLICATIONS

This application is a National Stage Application of PCT International Application No. PCT/US2016/061907, filed Nov. 14, 2016, which claims the benefit of U.S. Provisional Patent Application No. 62/254,503, filed on Nov. 12, 2015. The disclosures of the above applications are incorporated herein by reference.

BACKGROUND

The counterfeiting of goods, products, packages, spare parts, pharmaceuticals and many other items is a growing problem, particularly in developing countries.

Therefore, it is desirable to provide an anti-counterfeiting device and method that is easy to use, inexpensive to manufacture, difficult to replicate or damage, to ensure a user of the authenticity of such goods, products, packages, spare parts, and pharmaceuticals

BRIEF SUMMARY

The present invention is directed to an anti-counterfeiting device comprising a first sensor configured to undergo a first user perceptible change in response to a first biologically produced stimulus that emanates directly from a biological source; and a second sensor configured to undergo a second user perceptible change in response to a second biologically produced stimulus that emanates directly from the biological source, the second biologically produced stimulus being different than the first biologically produced stimulus.

Other embodiments of the present invention include an anti-counterfeiting device comprising: a visible surface comprising a first authentication zone configured to transition between a first state and a second state in response to a first stimulus, the transition between the first state and the second state being perceptible to a user; and a second authentication zone configured to transition between a third state and a fourth state in response to a second stimulus that is different than the first stimulus, the transition between the third state and the fourth state being perceptible to the user.

Other embodiments of the present invention include an anti-counterfeiting device comprising a first substrate comprising an upper surface opposite a lower surface; a second substrate comprising an upper surface opposite a lower surface, the lower surface of the first substrate facing the upper surface of the second substrate; a first sensor applied to the upper surface of the first substrate, the first sensor configured to undergo a first user perceptible change in response to a first stimulus; and a second sensor positioned between the lower surface of the first substrate and the upper surface of the second substrate, the second sensor configured to undergo a second user perceptible change in response to a second stimulus.

In other embodiments, the present invention may include a method of authenticating a packaged product comprising: affixing an anti-counterfeiting device to a surface of the packaged product, the anti-counterfeiting device comprising a first sensor configured to undergo a first user perceptible change in response to a first biologically produced stimulus and a second sensor configured to undergo a second user perceptible change in response to a second biologically produced stimulus; exposing the anti-counterfeiting device to the first biologically produced stimulus and the second biologically produced stimulus; and assessing authenticity of the packaged product by observing whether the first user perceptible change and the second user perceptible change have taken place.

Other embodiments of the present invention include an anti-counterfeiting device comprising: a first substrate comprising an upper surface opposite a lower surface, a first sensor applied to the upper surface of the first substrate, the first sensor configured to undergo a first user perceptible change in response to a first stimulus; and a second sensor applied to the upper surface of the first substrate, the second sensor configured to undergo a second user perceptible change in response to a second stimulus.

In other embodiments, the present invention may include an anti-counterfeiting device comprising a sensor that is configured to emit a first color and a second color, whereby the sensor switches between the first color and the second color in response to pH change, and the first color is different from the second color.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
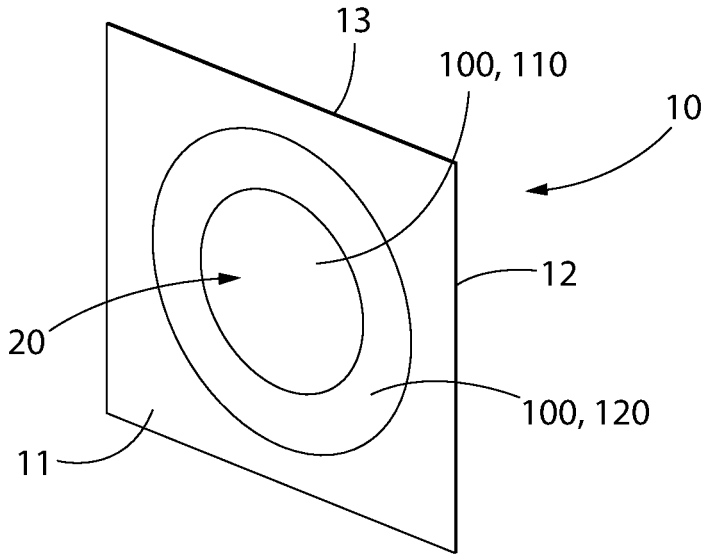
FIG. 1 is a perspective view of an anti-counterfeiting device according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the device and designated parts thereof. The terminology includes the above-listed words, derivatives thereof, and words of similar import. Additionally, the words "a" and "an", as used in any claims and in the corresponding portions of the specification, mean "at least one."

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means +/−5% of the reference value.

Referring to the drawing in detail, there is shown a presently preferred embodiment of an anti-counterfeiting device and method in accordance with the present invention. The anti-counterfeiting device and method utilize nanotechnology to verify the authenticity of goods sold. The anti-counterfeiting device may be any type of label, tag, identifier, stamp and the like. For the sake of brevity, the anti-counterfeiting device is also referred to herein as an anti-counterfeiting stamp or anti-counterfeiting label.

Figure 2:
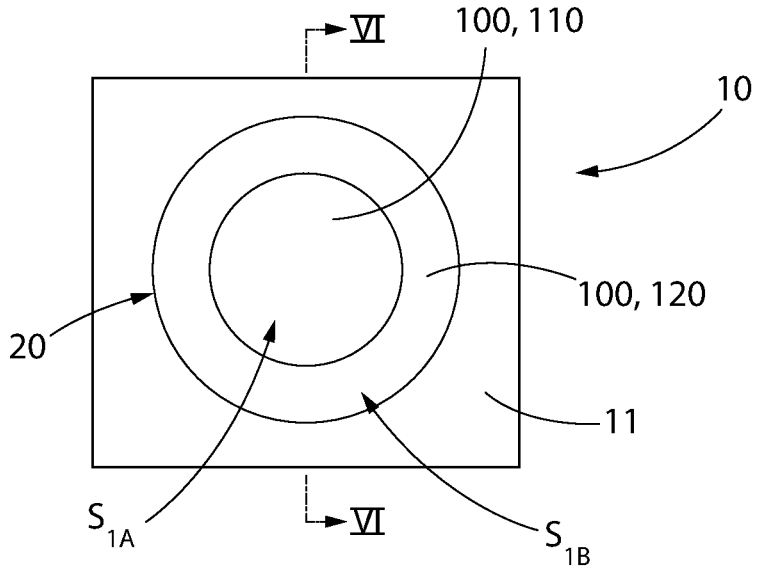
FIG. 2 is a top view of the anti-counterfeiting device of FIG. 1.

Referring to FIGS. 1 and 2, the anti-counterfeiting device 10 generally comprises an upper surface 11 opposite a lower surface 12, and side surfaces 13 extending there-between.

The upper surface 11 forms a visible surface 20 includes one or more authentication zones 100. In the exemplified embodiment of FIGS. 1-5, the anti-counterfeiting device 10 has a visible surface 20 that comprises a first authentication zone 110 and a second authentication zone 120. In other embodiments, the visible surface 20 of the present invention may have additional authentication zones 100, such as three, four, five, six, seven, eight, nine, etc., authentication zones 100. Having multiple authentication zones 100, 110, 120 provides a multi-step confirmation process that better ensures the genuineness of the attached good—as discussed further herein.

Each of the authentication zones 100 exhibits a user perceptible response (also referred to as a "user perceptible change") to external stimulus that is perceptible from the visible surface 20. While each of the authentication zones 100 may be located on the visible surface 20 of the anti-counterfeiting device 10, the mechanisms that create the user perceptible response may exist within the anti-counterfeiting device 10—i.e., beneath the visible surface 20 of the anti-counterfeiting device 10. It is also possible that at least some of the mechanisms that create the user perceptible response may exist on the visible surface 20 of the anti-counterfeiting device 10.

Generally, the user perceptible response of each authentication zone 100 may be the result of one or more sensors 300 present in the anti-counterfeiting device 10. Each sensor 300 may be capable of exhibiting the user perceptible response when exposed to a stimulus. Each sensor 300 may be in a first state $S_1$ prior to being exposed to the stimulus, and upon being exposed to the stimulus that sensor 300 will transition from the first state $S_1$ to a second state $S_2$, whereby the user perceptible response may be perceiving the sensor 300 in the second state $S_2$ and/or the change from the first state $S_1$ to the second state $S_2$.

In a non-limiting example, the first state $S_1$ the sensor 300 may emit a first color, and in the second state $S_2$ the sensor 300 may emit a second color—whereby the first color may be different from the second color. Thus, upon exposing the sensor 300 to a stimulus the user may perceive the authentication zone 100 transition from a first color (first state $S_1$) to a second color (second state $S_2$). The first state $S_1$ may also provide other visual indicia, such as a first pattern, and the second state $S_2$ may be a second pattern—whereby the first and second patterns are different.

The first color may be any single color on the visible spectrum (e.g., violet, blue, green, yellow, orange, red) as well as color combinations. The second color may be any single color on the visible spectrum (e.g., violet, blue, green, yellow, orange, red) as well as various color combinations. It is preferred that the first color be different from the second color.

The phrase "user perceptible response" (or "user perceptible change") refers to a response that can be observed by the user when viewing the uppermost surface 11 of the anti-counterfeiting device 10 with a naked eye. Stated otherwise, the phrases "user perceptible response" or "user perceptible change" refers to the user being able to observe the sensor 300 in the first state $S_1$, the second state $S_2$—as well as the transition from the first state $S_1$ to the second state $S_2$—without necessitating an intermittent step or using additional hardware such as spectroscopy or UV sensitive equipment to observe the first state $S_1$, second state $S_2$, or transition there-between.

The sensor 300 of the present invention is responsive to stimulus that originates and emanates from a biologic source. For the purpose of this invention, such stimulus will be referred to as "biologically produced stimulus." Such biologically produced stimulus refers to that which can naturally and directly emanate from a biological source (e.g., a human user). Non-limiting examples of such biologically produced stimulus include, but are not limited to: change in temperature, application of pressure, and exposure to changes in pH or exposure to water vapor and/or VOC compounds found in human breath, sweat, salvia, or naturally occurring oils on human skin and/or hair. A sensor 300 that is responsive to human breath is herein referred to as "breath sensor." A sensor 300 that are responsive to the application of pressure is herein referred to as "pressure sensor."

As will be discussed in greater detail later, a non-limiting examples of sensors 300 that are suitable for producing a user perceptible response based on a biologically produced stimulus include a colorimetric-based stamp/sensor or an anti-counterfeiting stamp/sensor based on metal oxide nanoparticles, colloidal photonic crystals and/or a photonic crystal gel system on a responsive polymer surface—as well as combinations thereof. Such sensors 300 may exhibit a transformation from a first state $S_1$ to a second state $S_2$ in response to being exposed to a user's breath—i.e., a breath sensor. Additionally, a non-limiting example of a pressure sensor includes metastable silica nanoparticles in the form of a colloidal crystalline array (CCA) gel.

Figure 4:
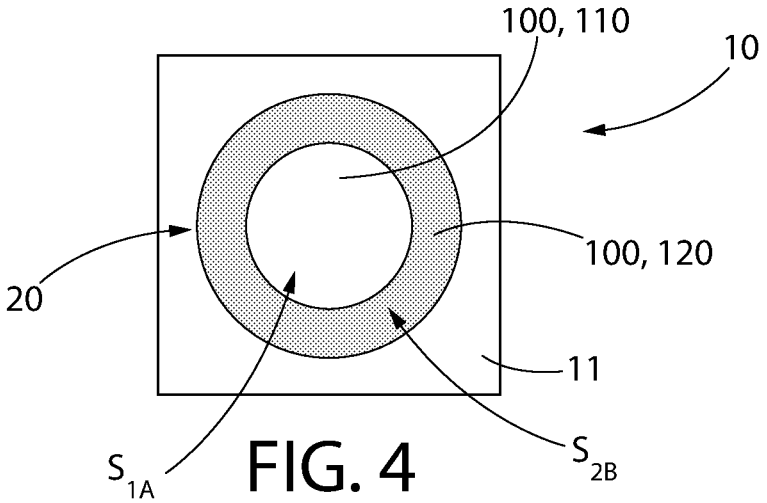
FIG. 4 is a top view of the anti-counterfeiting device in a second partially activated state.
Figure 5:
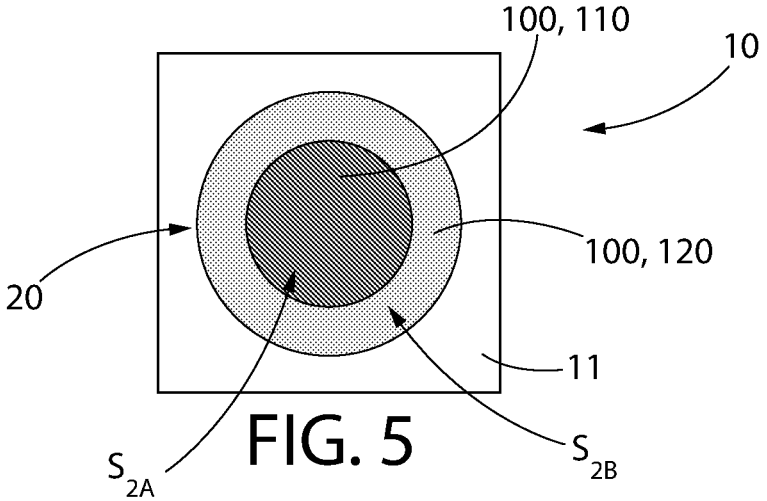
FIG. 5 is a top view of the anti-counterfeiting device in a fully activated state.
Figure 6:
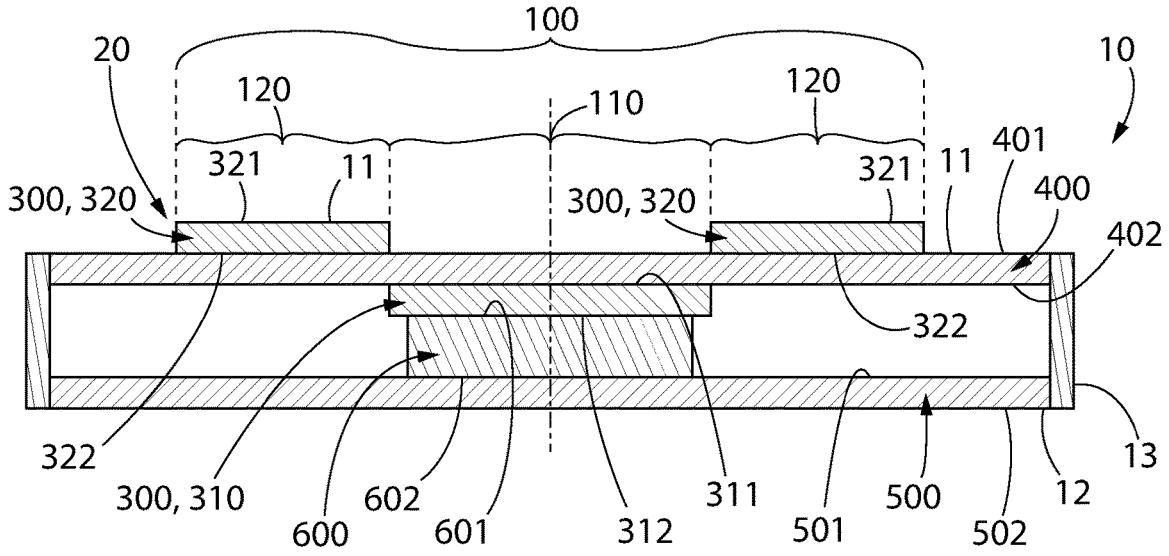
FIG. 6 is a cross-sectional view of the anti-counterfeiting device along line VI as shown in FIG. 2.
Figure 8:
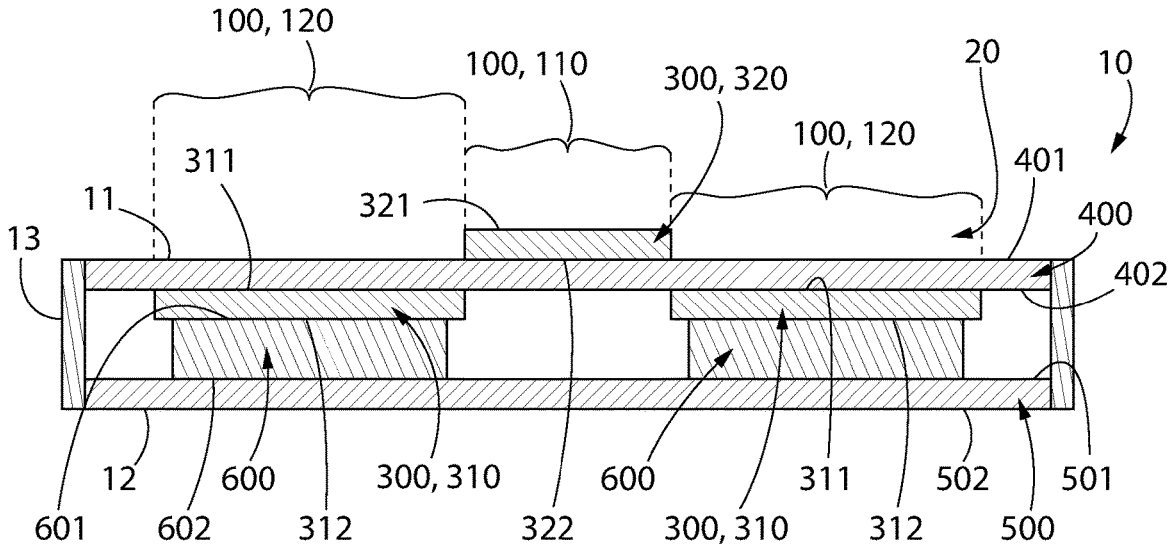
FIG. 8 is a cross-sectional view of the anti-counterfeiting device according to another embodiment as shown along line VI as shown in FIG. 2.
Figure 10:
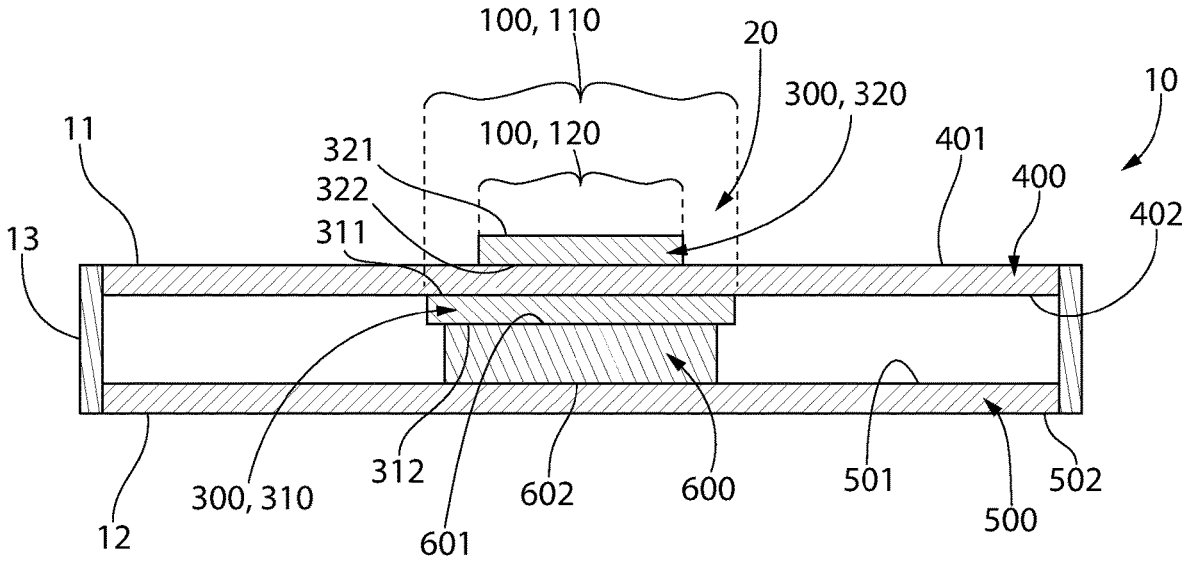
FIG. 10 is a cross-sectional view of the anti-counterfeiting device according to another embodiment as shown along line VI of FIG. 2.

Referring now to FIGS. 1-5, the authentication display 20 comprises at least two authentication zones—i.e., a first authentication zone 110 and a second authentication zone 120. As shown in FIGS. 6 and 10, some embodiments of the present invention provide that the first authentication zone 110 may be formed using at least one pressure sensor 310 and the second authentication zone 120 may be formed using at least one breath sensor 320. In other embodiments and as shown in FIG. 8, the first authentication zone 110 may be formed using at least one breath sensor 320 and the second authentication zone 120 may be formed using at least one pressure sensor 320.

The first authentication zone 110 may be immediately adjacent to the second authentication zone 120 on visible surface 20 of the anti-counterfeiting device 10. The first authentication zone 110 may be completely surrounded by the second authentication zone 120, when viewing the visible surface 20 of the anti-counterfeiting device 10. Although not pictured, other embodiments provide a first authentication zone 110 that may be partially surrounded by the second authentication zone 120, when viewing the visible surface 20 of the anti-counterfeiting device 10. Although not pictured, other embodiments provide a first authentication zone 110 that may be entirely isolated from the second authentication zone 120 on the visible surface 20 of the anti-counterfeiting device 10 by an isolation distance that is greater than zero—i.e., there is no overlap between the first and second authentication zones 110, 120. In other embodiments, the first authentication zone 110 may at least partially overlap the second authentication zone 120 on the visible surface 20 of the anti-counterfeiting device 10 by an overlap distance.

The authentication zones 100 may occupy about 1% to about 100% of the surface area available on the visible surface 20 of the anti-counterfeiting device 10—including all percentages and sub-ranges there-between. For embodiments directed to multiple authentication zones—i.e., the first authentication zone 110 and the second authentication 120—that do not overlap, each of the authentication zones 100, 110, 120 may occupy about 1% to about 99% of the surface area available on the visible surface 20 of the anti-counterfeiting device 10, whereby the sum off all surface area is no greater than 100% of the surface area of the visible surface 20 of the anti-counterfeiting device 10.

For embodiments directed to multiple authentication zones that overlap, each of the authentication zones 100, 110, 120 may occupy about 1% to about 99% of the surface area available on the visible surface 20 of the anti-counterfeiting device 10, whereby the sum off all surface area may be greater than 100% of the surface area of the visible surface 20 of the anti-counterfeiting device.

Referring now to FIGS. 6-11, the anti-counterfeiting device 10 may comprise a pressure sensor 310 having an upper surface 311 opposite a lower surface 312. The anti-counterfeiting device 10 may further comprise a breath sensor 320 having an upper surface 321 opposite a lower surface 322. The anti-counterfeiting device 10 may comprise a first support layer 400 that supports one or more of the sensors 300. The first support layer 400 may be substantially transparent. In other embodiments, the first support layer 400 may be translucent and colored with a pigment.

The first support layer 400 (also referred to as a "first substrate") may have an upper surface 401 opposite a lower surface 402. The first support layer 400 may comprise a plurality of intermediate layers stacked together to form a laminate structure. In other embodiments, the first support layer 400 may a single layer. The anti-counterfeiting device 10 may further comprise a second support layer 500 (also referred to as a "second substrate") having an upper surface 501 opposite a lower surface 502. The second support layer 500 may comprise a plurality of intermediate layers stacked together to form a laminate structure. In other embodiments, the second support layer 500 may a single layer.

The second support layer 500 may be positioned beneath the first support layer 400. The first support layer 400 and the second support layer 500 may be connected by side walls that form the side surfaces 13 of the anti-counterfeiting device 10. The side walls may be vertical or substantially vertical. The side walls may be angled upward in a direction from the second support layer 500 to the first support layer 400.

The breath sensor 320 may be positioned atop the first support layer 400 such that the lower surface 322 of the breath sensor 320 faces the upper surface 401 of the first support layer 400. The lower surface 322 of the breath sensor 320 may be in direct contact with the upper surface 401 of the first layer 400. In other embodiments, an intermediate layer may be positioned between the lower surface 322 of the breath sensor 320 and the upper surface 401 of the first support layer 400 (not pictured).

By being positioned atop the first support layer 400, it is possible for the breath sensor 320 to form at least a part of the visible surface 20 of the anti-counterfeiting device 10. Under this arrangement, the breath sensor 320 may remain exposed to the surrounding environment allowing it to receive breath from the user during the authentication process. Although not pictured, some embodiments of the present invention may further include a vapor-permeable membrane that can be positioned atop the upper surface 321 of the breath sensor 320. The vapor permeable membrane may protect the breath sensor 320 from debris and contamination while still allowing for the user's breath to contact the breath sensor 320 during the authentication process.

The pressure sensor 310 may be positioned beneath the first support layer 400 such that the upper surface 312 of the pressure sensor 310 faces the lower surface 402 of the first support layer 400. In some embodiments, the upper surface 312 of the pressure sensor 310 may be in direct contact with the lower surface 402 of the first support layer 400. In other embodiments, an intermediate layer may be positioned between the upper surface 312 of the pressure sensor 310 and the lower surface 402 of the first support layer 400 (not pictured). When the first support layer 400 is transparent or substantially transparent, the user perceptible change (e.g., color change, pattern change) can be seen when viewed from the visibly surface 20 of the anti-counterfeiting device 10. In other embodiments, when the first support layer 400 is translucent due to pigmentation, the first support layer 400 may modify the user perceptible change of the pressure sensor 310 according to a desired predetermined appearance.

The second support layer 500 may be positioned beneath the first support layer 400 and the pressure sensor 310. The second support layer 500 may comprise an upper surface 501 opposite a lower surface 502. The upper surface of 501 of the second support layer 500 may face the lower surface 402 of the first support layer 400 as well as the lower surface 312 of the pressure sensor 310. The lower surface 502 of the second support layer 500 may form the lower surface 12 of the anti-counterfeiting device 10.

The anti-counterfeiting device 10 may further comprise a platform 600 having an upper surface 601 opposite a lower surface 602. The platform 600 may be positioned beneath the pressure sensor 310 such that the upper surface 601 of the platform 600 faces the lower surface 312 of the pressure sensor 310. The lower surface 312 of the pressure sensor 310 may be in direct contact with the upper surface 601 of the platform 600. In other embodiments, an intermediate layer may be positioned between the lower surface 312 of the pressure sensor 310 and the upper surface 601 of the platform 600 (not pictured). The combination of first support layer 400, second support layer 500, and optionally the side walls may form a housing in which the pressure sensor 310 and platform 600 are located. The second support layer 500 may function as a support layer by providing support to the platform 600, thereby also supporting the pressure sensor 310.

As demonstrated by FIGS. 1-5, the first authentication zone 110 may extend along the visual surface 20 of the anti-counterfeiting device 10 to a first perimeter—thereby forming a solid shape (such as a circle, ellipsis, or polygon). The second authentication zone 120 may at least partially surround the first authentication zone 110 such that the second authentication zone 120 abuts the first perimeter—thereby forming a ring shape that surrounds the solid shape of the first authentication zone.

In other embodiments, the first and second authentication zone 110, 120 may each form solid shapes (e.g., circle, ellipsis, polygon) that are isolated from each other on the visual surface 20. In such embodiments, the breath sensor 320 and the pressure sensor 310 may be entirely horizontally offset from each other (not shown). In other embodiments, the first and second authentication zone 110, 120 may each form solid shapes (e.g., circle, ellipsis, polygon) that at least partially overlap (see FIGS. 10 and 11) on the visual surface 20. In such embodiments, the breath sensor 320 and the pressure sensor 310 may be partially horizontally offset from each other.

Figure 12:
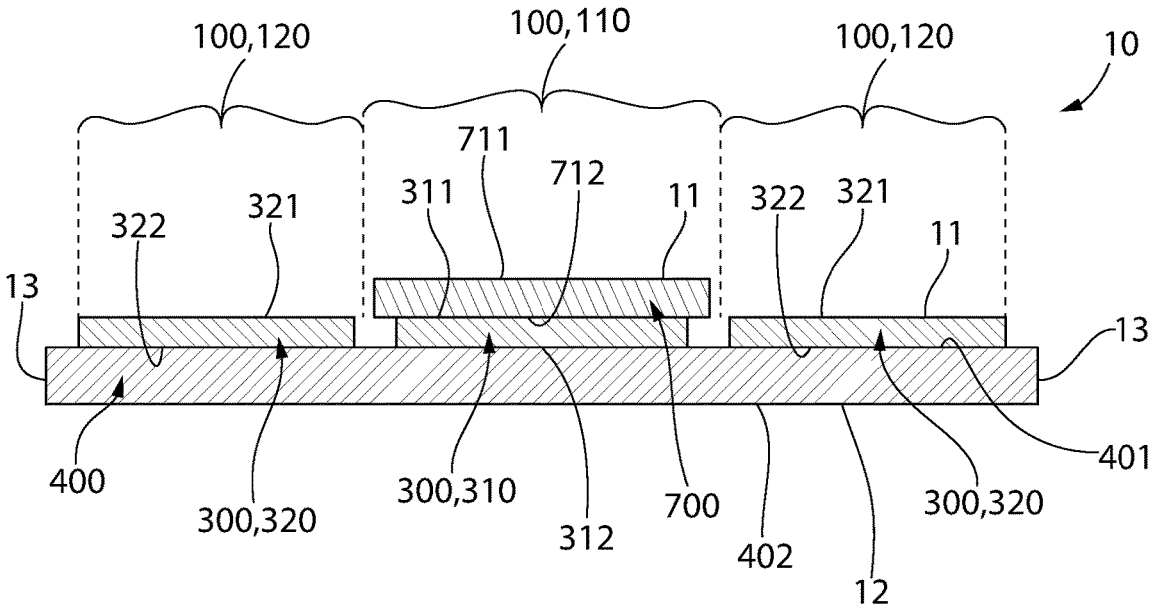
FIG. 12 is a cross-sectional view of the anti-counterfeiting device according to another embodiment as shown along line VI of FIG. 2.
Figure 13:
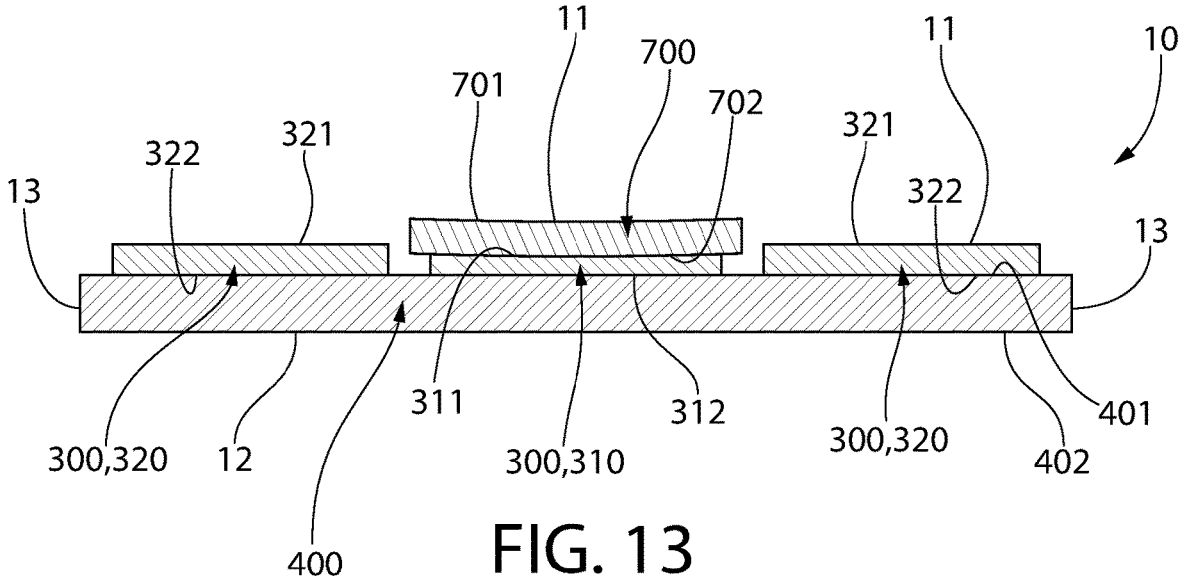
FIG. 13 is a cross-sectional view of the anti-counterfeiting device of FIG. 12 in a deflected state.
Figure 14:
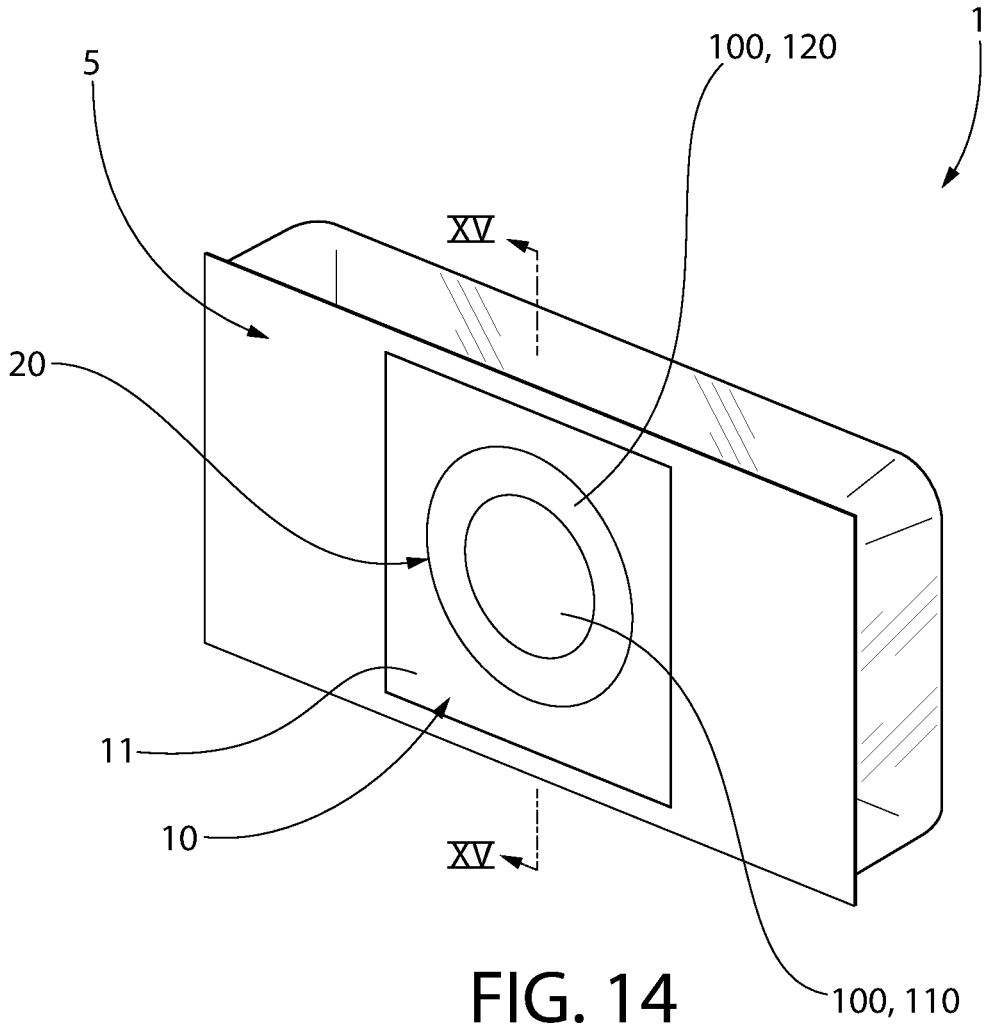
FIG. 14 is a perspective view of a packaged product labeled comprising the anti-counterfeiting device according to the present invention.

Referring now to FIGS. 12 and 13, other embodiments of the present invention include an anti-counterfeiting device 10 comprising a first support layer 400, whereby both the pressure sensor 310 and the breath sensor 320 are atop the upper surface of the first support layer. Specifically, the lower surface 322 of the breath sensor 320 and the lower surface 312 of the pressure sensor 310 face the upper surface 401 of the first support layer 400. The lower surfaces 312, 322 of the pressure sensor 310 and the breath sensor 320 may be in direct contact with the upper surface 401 of the first support layer 400. In other embodiments, an intermediate layer may be positioned between the lower surfaces 312, 322 of the pressure sensor 310 and the breath sensor 320 and the upper surface 401 of the first support layer 400 (not pictured). According to this embodiment, both the pressure sensor 310 and the breath sensor 320 may for at least a portion of the visual surface 20 of the anti-counterfeiting device 10.

The anti-counterfeiting device may further comprise a press layer 700 that has an upper surface 711 opposite a lower surface 712. The press layer 700 may be applied atop the upper surface 311 of the pressure sensor 310 to help prevent from debris, moisture, and other unwanted substances from contaminating the pressure sensor 310.

The present invention includes an authentication method comprising affixing the anti-counterfeiting device 10 to a surface of a packaged product 5. A user may then expose the sensor 300 to one or more biologically produced stimulus (e.g., human breath) whereby the sensor 300 then emits one or more user perceptible responses (e.g., changing from a first color to a second color) that can be observed from the uppermost surface 11 of the anti-counterfeiting device 10.

Referring now to FIGS. 2-5, a user may expose the anti-counterfeiting device 10 to a first biologically produced stimulus (e.g., human breath) whereby a first sensor 310 emits a first user perceptible change (e.g., changing from a first color to a second color) in response to the first biologically produced stimulus. A non-limiting example includes exposing the anti-counterfeiting device 10 to the user's breath, causing the breath sensor 310 to transition between a first state $S_{1B}$ and a second state $S_{2B}$. The transition of the breath sensor 310 from the first state to the second state creates the user perceptible change that can be perceived from the first authentication zone 110 on the visual surface 20 of the anti-counterfeiting device.

Similarly, a user may expose the anti-counterfeiting device 10 to a second biologically produced stimulus (e.g., pressure from the user's fingers) whereby a second sensor 320 emits a second user perceptible change (e.g., changing from a first color to a second color) in response to the second biologically produced stimulus. The transition of the pressure sensor 320 from the first state to the second state creates the user perceptible change that can be perceived from the second authentication zone 120 on the visual surface 20 of the anti-counterfeiting device.

Figure 7:
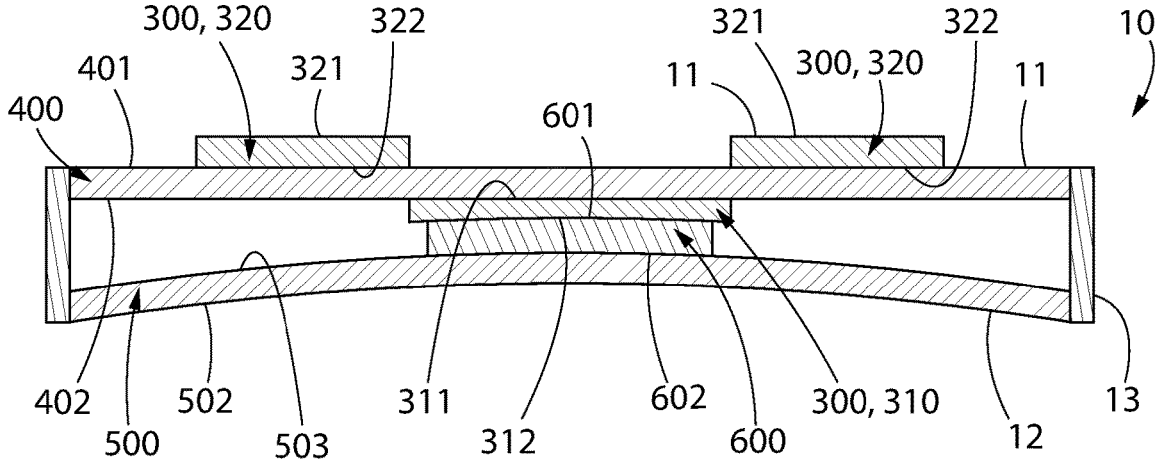
FIG. 7 is a cross-sectional view of the anti-counterfeiting device of FIG. 6 in a deflected state.
Figure 9:
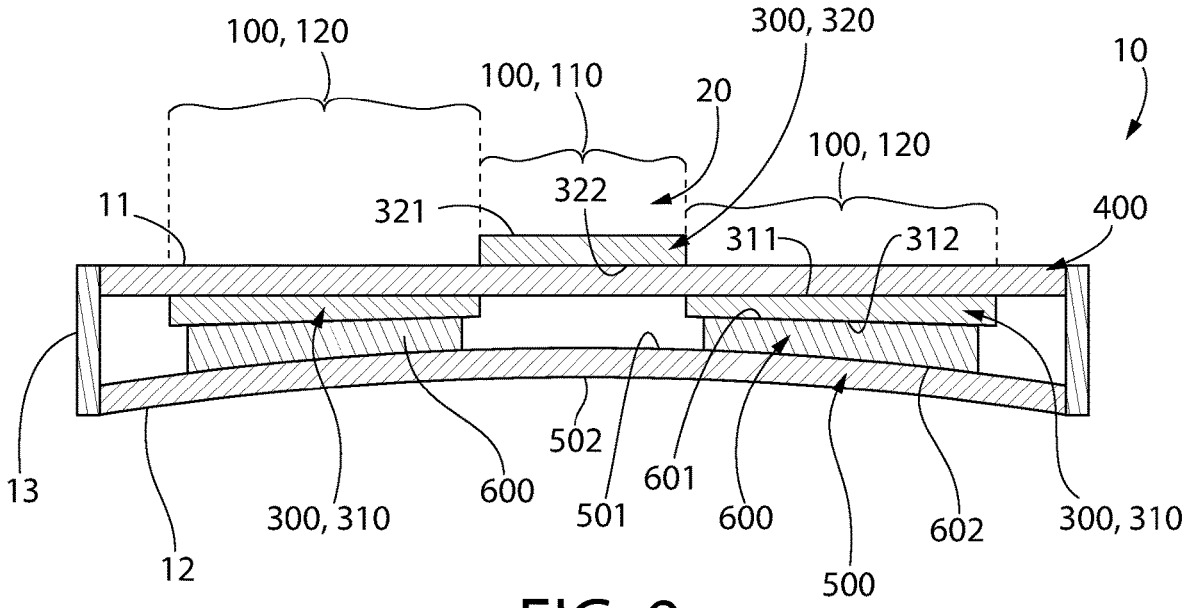
FIG. 9 is a cross-sectional view of the anti-counterfeiting device of FIG. 8 in a deflected state.
Figure 11:
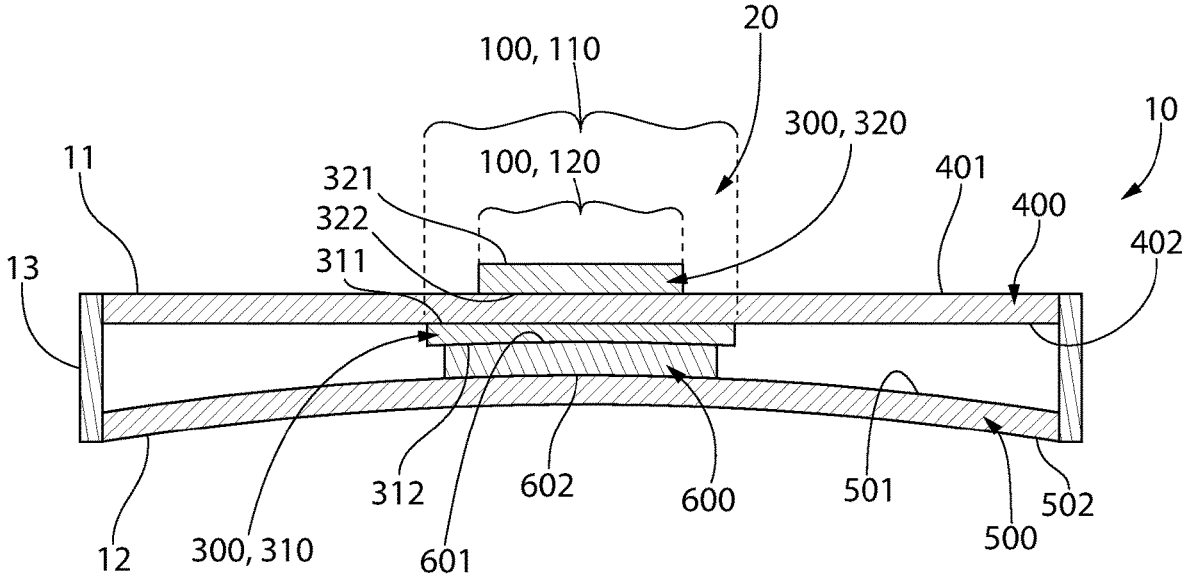
FIG. 11 is a cross-sectional view of the anti-counterfeiting device of FIG. 10 in a deflected state.

Applying pressure as the biologically produced stimulus, may cause the second support layer 500 to deform (as shown in FIGS. 7, 9, and 11), thereby pushing the platform 600 into the pressure sensor 310. The pressure sensor 310 deforms as the platform 600 presses upward, thereby causing the pressure sensor 310 to change color (i.e., give the user perceptible response). Specifically, the second support layer 500 may be designed to function as a cantilever that rises or reciprocates in an upward direction toward the first support layer 400, thereby compressing the pressure sensor 310 whenever pressure is applied on the corners (i.e., pressure points) of the first and or second layers 400, 500, as shown in FIGS. 7, 9, and 11.

Alternatively, according to the embodiment shown in FIGS. 12 and 13, the user may directly apply pressure to the pressure sensor 310 by pressing downward on the upper surface 311 of the pressure sensor 310. For the embodiments comprising a press layer 700, the user may indirectly apply pressure to the pressure sensor 310 by directly pressing on the upper surface 711 of the press layer 700, thereby indirectly causing pressure to be applied to the upper surface 311 of the pressure sensor 310 via the lower surface 712 of the press layer 700.

Figure 3:
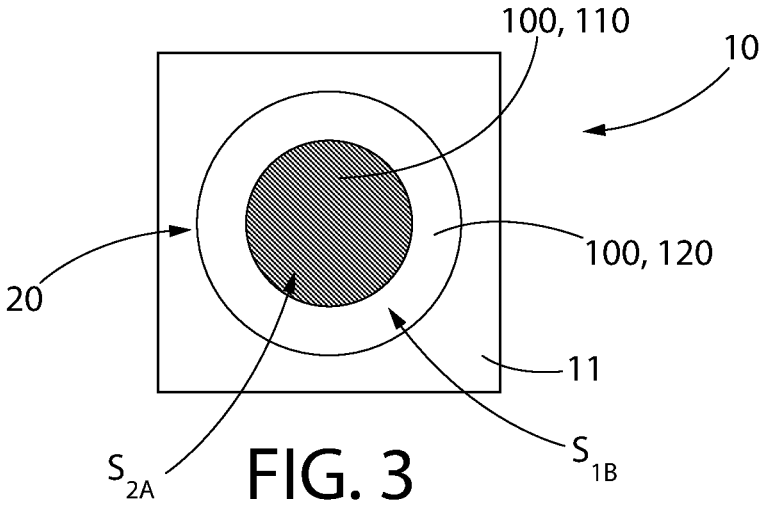
FIG. 3 is a top view of the anti-counterfeiting device in a first partially activated state.

Each of the authentication zones 100 may transition between the first state $S_1$ and the second $S_2$ independently. As demonstrated by FIGS. 2-5, the first authentication zone 110 may transition between a first state $S_{1A}$ and a second state $S_{2A}$ and the second authentication zone 120 may independently transition between a first state $S_{1B}$ and a second state $S_{2B}$. Specifically, as shown in FIG. 3, the first authentication zone 110 may transition from the first state $S_{1A}$ to the second $S_{2A}$ independent from the second authentication zone 120. Similarly, as shown in FIG. 4, the second authentication zone 120 may transition from the first state $S_{1B}$ to the second state $S_{2B}$ independent from the second authentication zone 120.

The first authentication zone 110 may also transition from the first state $S_{1A}$ to the second $S_{2A}$ for a first period of time. The second authentication zone 120 may transition from the first state $S_{1B}$ to the second state $S_{2B}$ for a second period of time. The first period of time may have no overlap with the second period of time—thereby resulting in the anti-counterfeiting device 10 as shown in FIGS. 3 and 4. Alternatively, the first period of time may overlap the second period of time—thereby resulting in the anti-counterfeiting device 10 as shown in FIG. 5. When there is at least some overlap between the first period and the second period, both the first authentication zone 110 and the second authentication zone 120 are both in the second state $S_{2A}$, $S_{2B}$ for a concurrent period of time.

Using the user perceptible responses of each the first authentication zone 110 and the second authentication zone 120 that are the transitions between the first state $S_{1A}$, $S_{2A}$ and the second state $S_{2A}$, $S_{2B}$, the user can confirm the authenticity of a packaged product 5. Specifically, upon exposing the anti-counterfeiting device 10 to the first and second biologically produced stimulus and perceiving with the naked eye first user perceptible response of the first authentication zone 110—i.e., transitioning from the first state $S_{1A}$ to the second state $S_{2A}$—as well as perceiving with the naked eye the second user perceptible response of the second authentication zone 120—i.e., transitioning from the first state $S_{1B}$ to the second state $S_{2B}$—both transitions allow the user to assess the authenticity of the attached packaged good 5. Having the first authentication zone 110 and/or the second authentication zone 120 undergo the user perceptible change by not transitioning from the first state $S_{1A}$ $S_{1B}$ to the second state $S_{2A}$ $S_{2B}$ indicates that authenticity of the attached packaged good 5 may be in question.

The anti-counterfeiting device 10 may be exposed to the first biologically produced stimulus before the second biologically produced stimulus. Alternatively, the anti-counterfeiting device 10 may be exposed to the second biologically produced stimulus before the first biologically produced stimulus. Additionally, the anti-counterfeiting device 10 may be exposed to the first biologically produced stimulus and the second biologically produced stimulus at the same time.

The present invention may further comprise an anti-counterfeiting packaging system that comprises a packaged product 5, the anti-counterfeiting device 10 of the present invention, and a set of instructions (not pictured) that provide how to perform authenticity confirmation. The lower surface 12 of the anti-counterfeiting device 10 may be coupled and/or affixed to a surface of the packaged product 5 by any suitable means—such as adhesive. The anti-counterfeiting device 10 may be attached to the packaged product 5 such that the upper surface 11 of the anti-counterfeiting device 10 remains exposed to the surrounding environment and available for easy access for the user to perform the authentication method according to the present invention.

Figure 15:
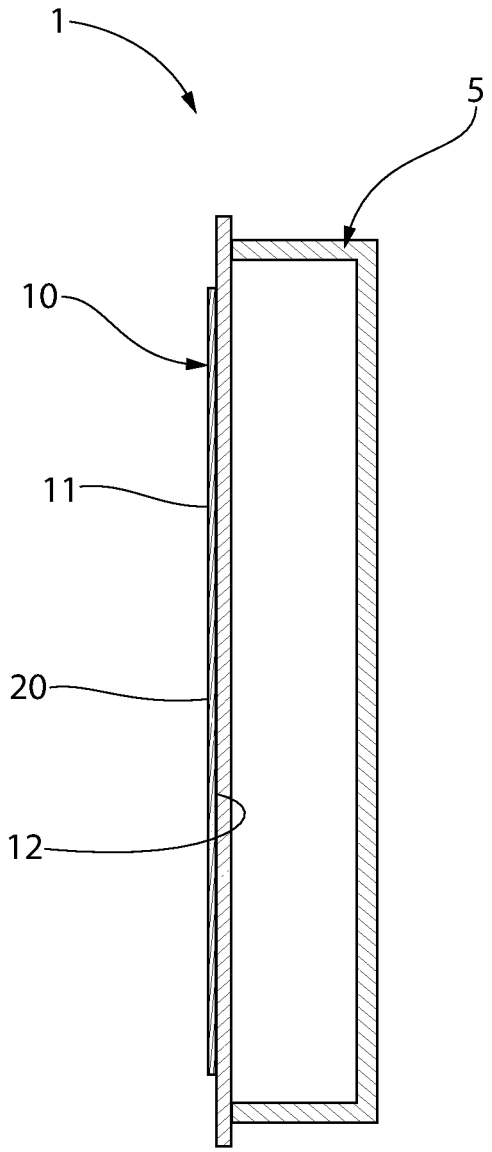
FIG. 15 is a cross-sectional view of the packaged product labeled comprising the anti-counterfeiting device shown in FIG. 14.
Figure 16:
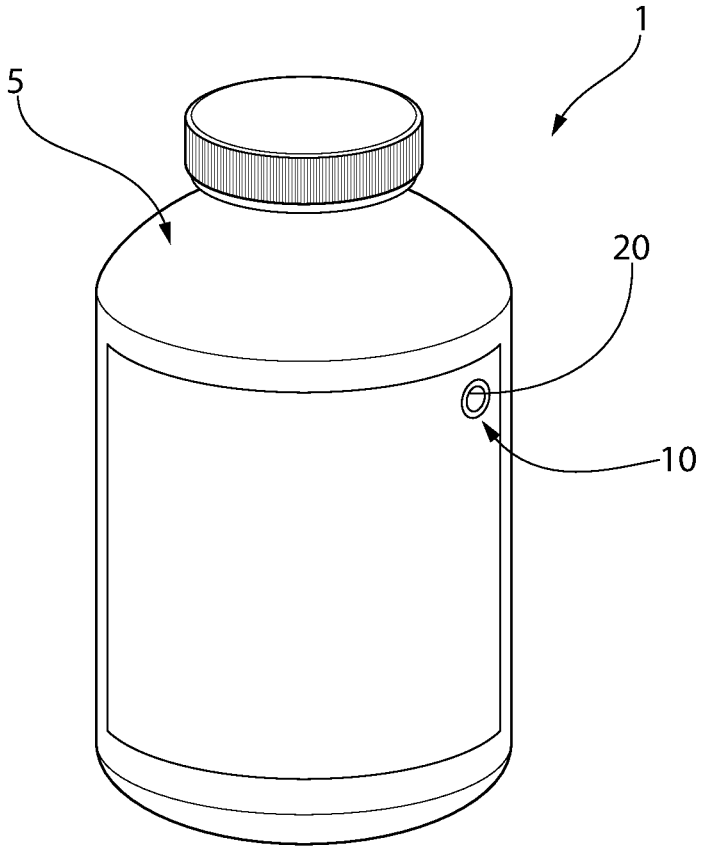
FIG. 16 is a perspective view of a packaged product comprising the anti-counterfeiting device according to the present invention.

Additionally, the anti-counterfeiting device 10 of the present invention may be scaled such that it can be attached to packaged products 5 that range in size of containers that housing large pluralities of individual goods (e.g., a pill bottle, as shown in FIG. 16) or containers that house individually portioned goods (i.e., a single-serving blister packs, as shown in FIG. 15). Such anti-counterfeiting protection is especially useful in settings when dosage is distributed not in bulk, but instead by individual amounts from medical professionals/pharmacists to users.

Non-limiting examples of breath sensors 300, 320 comprise solid silica nanoparticles (SSNs) and mesoporous silica nanoparticles (MSNs). The MSNs are prepared by growing a shell of silica on the SSNs and then heating the core-shell SSNs at a high temperature to remove the particles presents at the interface of core-shell, thus creating a pore throughout the shell. The MSNs are designed such that they reflect a particular wavelength of light (and thus a first or starting color) when an alcohol, such as ethanol, is absent and reflect a different wavelength of light (and thus a second or modified color) in the presence of a vapor containing an alcohol, such as ethanol vapors. When ethanol comes in contact with the shell of the MSNs, the ethanol changes the refractive index of the shell which consequently affects the color of the light reflected by the MSNs.

The human breath, in particular, contains volatile organic compounds (VOCs) which usually contain ethanol in an amount of less than 1 ppm. Accordingly, the breath sensor 300 is sensitive to human breath, and will change from reflecting a first color (i.e., the first state $S_1$) to reflecting a second color (i.e., the first state $S_2$) when subject to the application of human breath (i.e., by an individual simply breathing or blowing on the breath sensor 300, 320).

The color of the light emitted by the breath sensor 300 may depends on the thickness of the shell of the MSNs. The thicker the shell, the higher the wavelength. A wavelength of approximately 700 nm approaches a red color. Once the desired shell thickness is calculated and the MSNs are synthesized, the synthesized MSNs may then be used to prepare an emulsion to be used as an ink to be printed by an inkjet printer for forming the breath sensor 300, 320. The ink may be applied by other various methods as well—including roll printing, stamping, etc.

The breath sensor 300, 320 may be applied to the first support layer 400 to a thickness ranging from about 1 micron to about 5,000 microns—including all thicknesses and sub-ranges there-between.

Prior to printing of the ink that forms the breath sensor 300, 320, the surface chemistry of the first support layer 400 may be altered to remove the effect of angle of view. If the surface chemistry of the first support layer 400 is not altered, then after the nanoparticles have self-assembled, the color emission will depend on the angle of viewing. Removing the angle dependence of the emitted light requires alteration of the surface chemistry of the first support layer 400. Thus, the first support layer 400 is preferably a polymer-based substrate having a tunable hydrophilicity.

In one embodiment, the breath sensor 300, 320, and particularly the MSNs-based ink and substrate, are formed as follows. To make the MSNs, dry SSNs, of approximately 180-20 nm in diameter and 0.6 grams of silica spheres, 15 ml of aqueous ammonia (28 wt. %), 200 mL of absolute ethanol (EtOH), 400 mL of deionized water, and 3 mL of cetyltrimethylammonium chloride (25 wt. % in $H_2O$) (CTAC) are mixed together in a conical flask and stirred in a magnetic stirrer at a speed of approximately 1000 rpm to form a reaction mixture.

It will be understood by those skilled in the art that any known mixing technique may be used and mixing speeds may be in the range of 600 rpm to 1200 rpm. It will also be understood that instead of silica spheres, other materials, such as polystyrene, polymethyl methacrylate, titanium dioxide, iron oxide, gold and silver may be used.

After thirty minutes of stirring, tetraethoxysilane (TEOS) is added to the reaction mixture drop by drop. The amount of TEOS is calculated such that, for 0.3 grams of silica, 1 ml TEOS creates a shell that is 100 nm thick. The solution is subsequently stirred at ambient temperature overnight to achieve a series of MSNs with different mesoporous shell thicknesses depending upon the amount of TEOS added.

Then, the synthesized MSNs suspension is centrifuged and the solvent is disposed. The remaining solute, containing MSNs, is washed with ethanol and centrifuged again to separate it from the ethanol. The ethanol washing cycle is repeated, preferably 5 times, to remove the excess CTAC. Finally, the collected MSNs are dried overnight at a temperature of 343 K. The resulting dry composite powder is further heated in an oven in the presence of oxygen (i.e., calcined) at a temperature 823 K for approximately 6 hours, in order to completely remove CTAC, usually present in the shell, which creates pores as the CTAC is released.

Next, a printable ink is formed with the MSNs. The ink is formed by mixing ethylene glycol and water, in the ratio of 1:4, with 20% weight of the SSNs or MSNs. The components are preferably mixed in an ultrasonic bath at a temperature of 40° C. for approximately 10 minutes at the maximum frequency. The suspension is then filtered through an 800 nm pore size filter.

According to some embodiments, the first support layer 400 on which the ink is to be applied is prepared. The first support layer 400 is preferably formed of poly-di-methyl-siloxane (PDMS), but other materials, such as silicon, glass, paper, plastic, fiber and the like may alternatively be used. The surface chemistry of the first support layer 400 is altered for the reasons discussed above. To alter the surface chemistry of the substrate, a UV ozone cleaner was utilized to increase the hydrophilicity of the substrate, and more particularly to create a semi-hydrophilic substrate. Then, the first support layer 400 is placed in a culture dish with 0.5 mL of EtOH solution containing 1 wt. % alkoxysilane (triethoxyoctylsilane) to obtain a 90° contact angle, and the mixture was heated at a temperature of 60° C. for approximately 1 hour to gain different wettability. Finally, a printing platform is utilized to print the ink onto the altered upper surface 401 of the first support layer 400, which are then heated at a temperature of 35° C. to allow the nanoparticles to self-assemble.

The ink that forms the breath sensor 300, 320 preferably reflects a first color (i.e. first state $S_1$), such as green, and then changes to a second color (i.e., second state $S_2$), such as orange, when subject to the application of human breath.

One or more of the sensors 300 of the present invention may be a pressure sensitive sensor 300, 310 (herein referred to as "pressure sensor"). Such pressure sensors 300, 310 may comprise metastable silica nanoparticles in the form of a colloidal crystalline array (CCA) gel. This array is highly sensitive to weak external forces and responds within milliseconds. The gel that may form the pressure sensors 300, 310 preferably responds to pressure changes by changing the color of reflected light. The gel of the pressure sensors 300, 310 may reflect the a first color (i.e., a first state $S_1$) and then changes to a second color (i.e., a second state $S_2$) that is different from the first color when subject to the application of pressure—as discussed further herein. The pressure sensors 300, 310 may be sensitive to pressures in the range of 0 to 1000 kPa. The second color of the pressure sensor 300, 310 may remain present for a predetermined duration of time ranging from about 20 milliseconds to about 2000 milliseconds, and more preferably from about 1000 milliseconds to about 2000 milliseconds, and then the pressure sensitive sensor 300 may reset to the first color.

The color of reflected light changes depending upon the wavelength with respect to the angle of reflection, which in turn depends on the deformation of the CCA gel. For example, the CCA gel preferably emits a first wavelength color (e.g., reflected as green), but upon deformation such as stretching the gel from the sides or pushing the gel from the top, the CCA gel emits a second wavelength color (e.g., reflected as blue), and upon a different type of deformation such as compressing the gel from the sides or pulling the gel from the center, another wavelength color (e.g., reflected as red) is emitted.

In one embodiment, to form the pressure sensor 300, 310, silica nanoparticles, and more particularly monodisperse $SiO_2$ particles, which have been synthesized by Staber method, are dispersed in ethanol and this solution is mixed with predetermined amounts of ethylene glycol (EG) and polyethylene glycol methacrylate (PEGMA). To obtain a uniform solution, the mixture is put in an ultrasonic bath for approximately 10 minutes and mixed at a high frequency. Next, once the nanoparticles are mixed monodispersely, the solution is kept in an oven to evaporate at 90° C. for approximately 2 hours to remove all of the ethanol, and then cooled down to room temperature. The predetermined amounts of the silica-ethanol solution, EG and PEGMA are selected such that a 40% volume fraction of silica, an approximately 40% volume fraction of EG and an approximately 20% volume fraction of PEGMA remains in the final suspension, after the removal of ethanol. After the evaporation of the ethanol, the residual liquid suspension has an iridescent color. Next, 0.03 ml of the liquid suspension is obtained and a photoinitiator (5% by weight) is added thereto, and the suspension is sandwiched between two glass slides. This arrangement is set aside for approximately 10 minutes to form a metastable CCA precursor.

Next, the arrangement is exposed to 365 nm UV light at a 4.8 $W/m^2$ intensity and allowed to cure for approximately 20 minutes. The UV curing process converts the liquid precursor suspension into a photonic crystal gel, which forms the pressure sensitive sensor 300.

The gel may then be applied on a substrate to form the pressure sensor 300, 310. To create the substrate, a solid negative mask of the desired structure is used. Silicone elastomer and a curing agent are mixed in the ratio of 10:1, and the mixture is slowly poured on the negative mask. The mixture is kept on a hot plate at a temperature of 70° C. for approximately 3-4 hours to allow any bubbles to be removed. The silicone elastomer cures into PDMS, which can be peeled off from the negative mask, to form the substrate. The substrate is preferably transparent or of a black color. In one embodiment, carbon powder is mixed with the silicone elastomer and the curing agent to form a darker colored substrate, which provides for better contrast against the gel of the pressure sensors 300, 310.

In a separate embodiment (not shown), the present invention includes an anti-counterfeiting device that comprises an array of chromophores. In particular, this embodiment includes a stamp comprising a colorimetric-based sensor and preferably includes an array of two or more fluorescent chromophores that emit different colors with strong luminescence. The stamp of the second embodiment is preferably an optical sensor and provides for colorimetric detection as it is rapid and can be detected by the naked eye. The stamp of the second embodiment is preferably a versatile platform for an efficient optical sensor that exhibits distinctive ratiometric color responses.

In one aspect, the chromophores are preferably quantum dots. More preferably, the stamp of the second embodiment comprises an array of responsive polymer and quantum dot hybrids integrated, or otherwise provided or applied, on a substrate. Preferably, the stamp of the second embodiment is made up of a hybrid quantum dot/polymer light conversion film applied on a substrate. In one aspect, the substrate is preferably a graphene or graphene oxide sheet, such that the stamp of the second embodiment is a graphene oxide-based optical sensor.

Graphene oxide is preferable as a sensing platform as it provides a high signal-to-noise ratio and has a long distance energy transfer rate. However, it will be understood that other materials having chemical and optical properties similar to graphene or graphene oxide, such as molybdenum disulfide, may be used to form the substrate. In particular, any material which provides for a long distance energy transfer range and energy transfer rate may be used.

Preferably, the graphene is built or grown on a base sheet to form the substrate. Preferably, the base sheet is a copper base sheet because copper provides nucleating sites for the carbon atoms. However, it will be understood that any material having such a property may be used to form the base sheet, such as nickel. It will also be understood that the graphene or graphene oxide substrate may be formed by any known or yet to be developed means.

In one aspect, the graphene is grown onto the base sheet and then converted to graphene oxide by the application of UV ozone or oxygen plasma, or by the simple application of heat. However, there are other known processes for growing graphene oxide (e.g., utilizing graphitic material and intercalating of the graphitic layers using any intercalating agent).

Accordingly, it will be understood that any known graphene growing process may be used to form the substrate of the stamp.

Alternatively, the graphene may be transferred to a base sheet to form the substrate of the stamp. In one aspect, the base sheet to which the graphene is transferred is formed of a transparent plastic. However, it will be understood that the base sheet may be formed of any material, such as paper, which can sustain graphene. It will also be understood that the transfer process may be accomplished by any known or yet to developed graphene transfer techniques.

The quantum dots are tiny particles or nanocrystals of a semiconducting material. The quantum dots of the stamp of the second embodiment may be sized or tuned so as to emit any desired distinctive color of light. In one aspect, the quantum dots are sized so as to emit only one color. In another aspect, the quantum dots are sized so as to emit at least two different colors. That is, at least two differently-sized quantum dots are included in the array of quantum dots, such that at least two different colors of light are emitted by the array. In one aspect, the colors emitted by the quantum dots are preferably blue and orange.

The quantum dots can be made up of any appropriate material, such as, but not limited to, semiconductors, metals, gold, and silver. In one aspect, the quantum dots are lead selenide quantum dots which emit blue and orange colors. However, it will be understood that any color of light may be emitted by the quantum dots simply by altering the size of the dots. In an alternative aspect, a dye of quantum dots is used to form the stamp.

In accordance with an aspect of the second embodiment, the photoluminescence emission of the colors from the quantum dots is preferably controlled using pH. Specifically, a polymer is preferably anchored to the quantum dots to tune the efficiencies of Forster resonance energy transfer (FRET). More preferably, the polymer is a pH sensitive or pH responsive polymer which will respond to the changes in the pH of the surrounding medium. Most preferably, the polymer is a pH responsive polymer having pyrene terminated groups. It will be understood that any pyrene-terminated polymer may be utilized, as such polymers can be anchored easily to the quantum dots surface by the strong interaction of n-n stacking. Preferably, however, pH responsive linkers poly(acrylic acid) and poly(2-vinylpyridine) that can tune the efficiencies of FRET are used.

The stamp of the present invention preferably illuminates (i.e., emits a colored light) when exposed to light of a certain spectrum, thereby indicating that the stamp is authentic. It will be understood that the light spectrum utilized and emitted correlates with the size of the quantum dot, and is not limited to only blue or orange colored light, but rather may include any colored light.

In one aspect, the stamp is applied to a package. The authenticity of the stamp may be tested by shining a light on the stamp to determine whether the stamp emits light of a first predetermined color (e.g., orange colored light). If so, the stamp and the contents of the package are most likely authentic. Thus, according to the presently claimed invention, only a single authentication step may be utilized. It also will be understood that the first predetermined color can vary based on the size of quantum dots used and any color is possible.

In another aspect, a second step may be utilized for authentication purposes. Specifically, further authentication of the stamp and package contents is also possible by the application of saliva or breath. Human breath and saliva have a pH 7-8 (i.e., generally basic or alkaline). Thus, the application of human breath or saliva on the stamp turns the stamp more "basic," thereby activating the pH responsive linkers which, in turn, tunes the FRET and causes the stamp to reflect a light of a second predetermined color (e.g., blue colored light). It will be understood that the second predetermined color can vary based on the size of quantum dots used and any color is possible. Thus, in one aspect, the stamp of the second embodiment also provides for a two-step authentication stamping device and process.

The sensor of this embodiment may be considered a nano-structure comprising quantum dots anchored by a pH response polymer. The quantum dot emits a first color and, in response to a pH change, the polymer modifies the emission properties of the nano-structure, thereby causing the quantum dot to emit a second color—whereby the second color is different from the first color.

Graphene oxide is a preferred platform for pH sensors since it provides for long-term stability. In one aspect, the stamp preferably has two different colored quantum dots (e.g., blue and orange) anchored to the single graphene oxide sheet with the assistance of the responsive polymer linkers. In one aspect, the light emission is pH dependent and is controlled by using linkers of two different pH responsive polymers that change their conformation in response to different ranges of pH values. More particularly, the two different pH responsive polymers, such as poly(acrylic acid) (PAA) and poly(2-vinylpyridine) (P2VP), act as linkers between the graphene oxide and the quantum dots to generate responses over a wide range of pH values.

In one aspect, the stamp is covered with a protective cover or membrane which allows vapors to permeate therethrough, but prevents removal of the quantum dots and other chemistry. It will be understood that any appropriate permeable material may be used to form the protective cover. For example, polymers and epoxy materials can be used as permeable membranes for vapor or moisture permeability. Examples of such materials include, but are not limited to, plywood (CDX), oriented strand board, fiberboard-asphalt, extruded polystyrene, glass faced with gypsum, fiber cement, vinyl, cellulose, icynene, linoleum, polyethylene, latex paint, acrylic paint, vinyl acrylic enamel, oil based paint, elastomeric paint, and the like. In one aspect, the protective cover is a plastic sheet. The protective cover or membrane may also act as a layer which converts artificial light (e.g., light from a mobile flashlight) or natural sunlight wavelength to a wavelength that correlates with the size of the quantum dots for highest intensity luminescence. For example, where the quantum dots are sized to emit blue and orange light, the protective cover or membrane is preferably configured to convert artificial or natural light to a wavelength of 365 nm for highest intensity. However, it will be understood that the protective cover or membrane may be configured to convert artificial or natural light to any wavelength which corresponds to the quantum dots utilized.

It will also be understood that another process or mechanism may be utilized to modify/conform the quantum dots and change the FRET efficiency specifically in order to change the wavelength of light exposed to the stamp. It will also be understood that any process that modifies the stamp in order to change the incoming light wavelength in order to emit light from the quantum dots may be utilized. For example, the most common process to convert wavelength is by passing light through a material (working as a lens) with a certain refractive index at a certain angle. Also, wavelength can be converted by passing light through plastics (mainly polystyrene) embedded with varying concentration of fluorescent materials (example benzoxanthene).

In one aspect, the stamp is part of a stamping system, wherein the stamping system includes a light source. Examples of the light source include, but are not limited to, a flashlight-like device, a mobile flash light, and the like. It will be understood that the light source may be any device which emits light at a certain wavelength or any attachment to a currently existing device, such as a mobile flash light, designed to change the wavelength of light in order to apply to make the quantum dots glow.

In one aspect, the stamp is applied to a pharmaceutical package containing medical drugs. In use, once a drug store customer approaches the pharmaceutical package, he/she may ascertain if the medical drugs contained therein are authentic (i.e., were actually provided from the identified manufacturer), and thus not counterfeit, by shining a light on the stamp. A first predetermined color (i.e., orange or any color tending toward red in one embodiment) would indicate to the customer that the medical drugs contained in the package are most likely authentic. However, to confirm the authenticity, the customer could then blow on the stamp. If the first predetermined color changes to the second predetermined color (i.e., a blue color in one embodiment), the customer would be assured that the medical drugs contained in the stamped package are authentic and not counterfeit It will be understood that the authenticity verification device and method of the present invention is not limited to the pharmaceutical context, but instead could be used for a variety of applications and goods and processes, such as clothes, sunglasses, documents, and the like. It will also be understood that the authenticity verification device and method of the present invention encompasses all color-changing methods of verifying authenticity, as well as all applications of applying light to a stamp which leads to a color emission, and subsequent application of saliva or blowing the breath which leads to a change in the color emission of the stamp.

It will be understood that the present invention encompasses the use of nanotechnology to verify authenticity and/or prevent counterfeiting, the use of any sort of illumination or lighting-up to verify authenticity and/or prevent counterfeiting, the use of graphene generally to verify authenticity and/or prevent counterfeiting, and the use of quantum dots generally to verify authenticity and/or prevent counterfeiting.

It will also be appreciated by those skilled in the art that changes could be made to the embodiments described above without departing from the broad inventive concepts thereof. It is understood, therefore, that this invention is not limited to the particular embodiments disclosed, but it is intended to cover modifications within the spirit and scope of the present invention as defined by the appended claims

What is claimed is:

1. An anti-counterfeiting device comprising:

a first sensor configured to undergo a first user perceptible change in response to a first biologically produced stimulus that emanates directly from a first biological source; and a second sensor configured to undergo a second user perceptible change in response to a second biologically produced stimulus that emanates directly from the first biological source, the second biologically produced stimulus being different than the first biologically produced stimulus.

2. The anti-counterfeiting device according to claim 1, wherein the first biologically produced stimulus is selected from at least one of change in temperature, application of pressure, change in pH, and exposure to human breath vapor.

3. The anti-counterfeiting device according to claim 1, wherein the first user perceptible change comprises transitioning from a first color to a second color, the first color being different from the second color.

4. The anti-counterfeiting device according to claim 3, wherein the transition from the first color to the second color is temporary.

5. The anti-counterfeiting device according to claim 1, wherein the first biological source is a human body.

6. The anti-counterfeiting device according to claim 1, wherein the second biologically produced stimulus is selected from at least one of change in temperature, application of pressure, pH change, and exposure to human breath vapor.

7. The anti-counterfeiting device according to claim 1, wherein the second user perceptible response comprises transitioning from a third color to a fourth color, the third color being different from the fourth color.

8. The anti-counterfeiting device according to claim 7, wherein the transition from the third color to the fourth color is temporary.

9. The anti-counterfeiting device according to claim 1, wherein the sensor is configured to undergo the first user perceptible change for a first period of time and the second user perceptible response for a second period of time, and the first period of time overlaps with the second period of time.

10. An anti-counterfeiting device comprising:

a visible surface comprising:

a first authentication zone configured to transition between a first state and a second state in response to a first stimulus, the transition between the first state and the second state being perceptible to a user; and a second authentication zone configured to transition between a third state and a fourth state in response to a second stimulus that is different than the first stimulus, the transition between the third state and the fourth state being perceptible to the user.

11. The anti-counterfeiting device according to claim 10, wherein the anti-counterfeiting device is configured such that the first authentication zone in the second state while the second authentication zone being in the fourth state.

12. The anti-counterfeiting device according to claim 10, wherein the transition from the first state to the second state of the first authentication zone is temporary.

13. The anti-counterfeiting device according to claim 10, wherein the transition from the third state to the fourth state of the second authentication zone is temporary.

14. The anti-counterfeiting device according to claim 10, wherein the first state is a first color and the second state is a second color, and wherein the first color is different from the second color.

15. The anti-counterfeiting device according to claim 10, wherein the third state is a third color and the fourth state is a fourth color, and wherein the third color is different from the fourth color.

16. The anti-counterfeiting device according to claim 10, wherein the first authentication zone and the second authentication zone overlap on the visible surface of the anti-counterfeiting device.

17. The anti-counterfeiting device according to claim 10, wherein the first authentication zone and the second authentication zone are isolated from each other on the visible surface of the anti-counterfeiting device.

18. The anti-counterfeiting device according to claim 10, wherein the first authentication zone and the second authentication zone are immediately adjacent to each other on the visible surface of the anti-counterfeiting device.

19. An anti-counterfeiting device comprising:

a first substrate comprising an upper surface opposite a lower surface;

a first sensor applied to the upper surface of the first substrate, the first sensor configured to undergo a first user perceptible change in response to a first stimulus; and a second sensor applied to the upper surface of the first substrate, the second sensor configured to undergo a second user perceptible change in response to a second stimulus.

20. The anti-counterfeiting device according to claim 19, wherein the first sensor emits a first color for a first period of time and the second sensor comprises a colloidal crystalline array gel, wherein the gel emits a second color for a second period of time, wherein the first period of time overlaps with the second period of time.

* * * * *